US010779087B2

(12) United States Patent
Wu et al.

(10) Patent No.: US 10,779,087 B2
(45) Date of Patent: Sep. 15, 2020

(54) VIBRATION DIAPHRAGM

(71) Applicant: AAC Technologies Pte. Ltd., Singapore (SG)

(72) Inventors: Meiwei Wu, Shenzhen (CN); Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 390 days.

(21) Appl. No.: 15/828,846

(22) Filed: Dec. 1, 2017

(65) Prior Publication Data

US 2018/0367908 A1 Dec. 20, 2018

(30) Foreign Application Priority Data

Jun. 20, 2017 (CN) ..... 2017 2 0722695 U

(51) Int. Cl.

| | |
|---|---|
| ***H04R 7/12*** | (2006.01) |
| ***G10K 13/00*** | (2006.01) |
| ***H04R 7/16*** | (2006.01) |
| ***H04R 7/18*** | (2006.01) |

(52) U.S. Cl.

CPC ..... *H04R 7/127* (2013.01); *G10K 13/00* (2013.01); *H04R 7/16* (2013.01); *H04R 7/18* (2013.01)

(58) Field of Classification Search

CPC . H04R 7/16; H04R 7/18; H04R 7/127; G10K 13/00

USPC ..... 181/167, 171

See application file for complete search history.

(56) References Cited

U.S. PATENT DOCUMENTS

| | | | | |
|---|---|---|---|---|
| 6,697,496 | B2 * | 2/2004 | Frasl | H04R 7/20 181/171 |
| 7,275,620 | B1 * | 10/2007 | Diedrich | H04R 7/16 181/171 |
| 7,306,073 | B2 * | 12/2007 | Frasl | H04R 7/14 181/157 |
| 7,801,324 | B2 * | 9/2010 | Kimura | H04R 9/06 381/423 |
| 7,866,439 | B2 * | 1/2011 | Windischberger | H04R 7/20 181/157 |
| 8,135,165 | B2 * | 3/2012 | Hatanaka | H04R 9/045 381/431 |
| 8,215,445 | B2 * | 7/2012 | Wildhagen | H04R 7/122 181/165 |
| 9,253,576 | B2 * | 2/2016 | Tripp | H04R 9/04 |
| 9,628,917 | B2 * | 4/2017 | Pircaro | H04R 9/00 |
| 10,149,063 | B2 * | 12/2018 | Watanabe | H04R 7/20 |
| 2004/0007420 | A1 * | 1/2004 | Takahashi | H04R 7/20 181/171 |

(Continued)

FOREIGN PATENT DOCUMENTS

| | | | | |
|---|---|---|---|---|
| WO | WO-2015076955 | A1 * | 5/2015 | H04R 7/16 |

*Primary Examiner* — Forrest M Phillips

(74) *Attorney, Agent, or Firm* — IPro, PLLC; Na Xu

(57) ABSTRACT

The present disclosure provides a vibration diaphragm. The vibration diaphragm includes a central dome part; and a suspension part surrounding the dome part. The suspension part has a protruding part and a fixation part extending outwards from the protruding part. The vibration diaphragm further includes a number of first reinforcing parts disposed on the suspension part; and a number of second reinforcing parts disposed on the suspension part. Each second reinforcing part surrounds an end of the first reinforcing part.

5 Claims, 2 Drawing Sheets

(56) References Cited

U.S. PATENT DOCUMENTS

| | | | | |
|---|---|---|---|---|
| 2007/0209866 | A1* | 9/2007 | Frasl | H04R 7/14 181/157 |
| 2010/0236861 | A1* | 9/2010 | Her | H04R 7/02 181/164 |
| 2014/0318885 | A1* | 10/2014 | Kim | H04R 7/02 181/171 |
| 2016/0014519 | A1* | 1/2016 | Oclee-Brown | H04R 7/00 381/398 |
| 2016/0014522 | A1* | 1/2016 | Matsumura | H04R 7/18 381/398 |
| 2016/0119716 | A1* | 4/2016 | Wang | H04R 7/16 181/171 |

* cited by examiner

VIBRATION DIAPHRAGM

FIELD OF THE PRESENT DISCLOSURE

The present disclosure relates to electro-acoustic transducers, more particularly to a vibration diaphragm for radiating audible sounds.

DESCRIPTION OF RELATED ART

With the rapid development of portable devices like mobile phone etc, people's requirement to the performance of the product is becoming stronger and stronger, and there is a vibration mode of music belt for the music appreciation of the mobile phone, in order to strengthen the entertaining effect, thus, the development of the sounding instrument is accelerating accordingly.

The sounding instrument with relevant technology comprises a frame, a vibration diaphragm supported on the frame and a voice coil driving the vibration of the vibration diaphragm. The vibration diaphragm comprises a dome and a suspension extending along the dome, and the voice coil is fixed on the suspension.

However, in the vibration diaphragm with relevant technologies, the traditional vibration diaphragm comprises the central dome part and the suspension part encircling the dome part, and the suspension part is a structure of a single pattern. However, due to its insufficient strength and even lower strength at the corner of the suspension part, such vibration diaphragms tend to collapse.

Therefore it is necessary to provide an improved vibration diaphragm for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
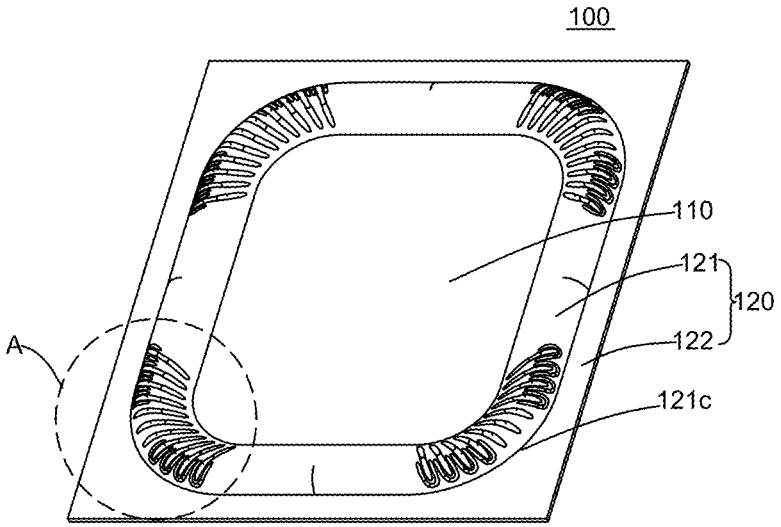
FIG. 1 is an illustrative isometric view of a vibration diaphragm in accordance with an exemplary embodiment of the present disclosure.
Figure 2:
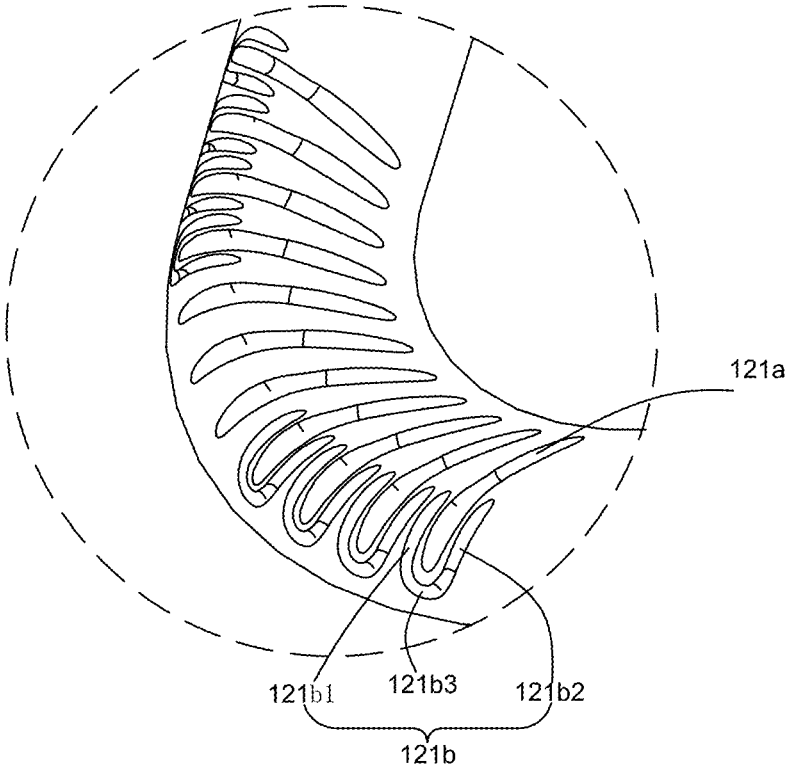
FIG. 2 is an enlarged view of Part A of the vibration diaphragm in FIG. 1.
Figure 3:
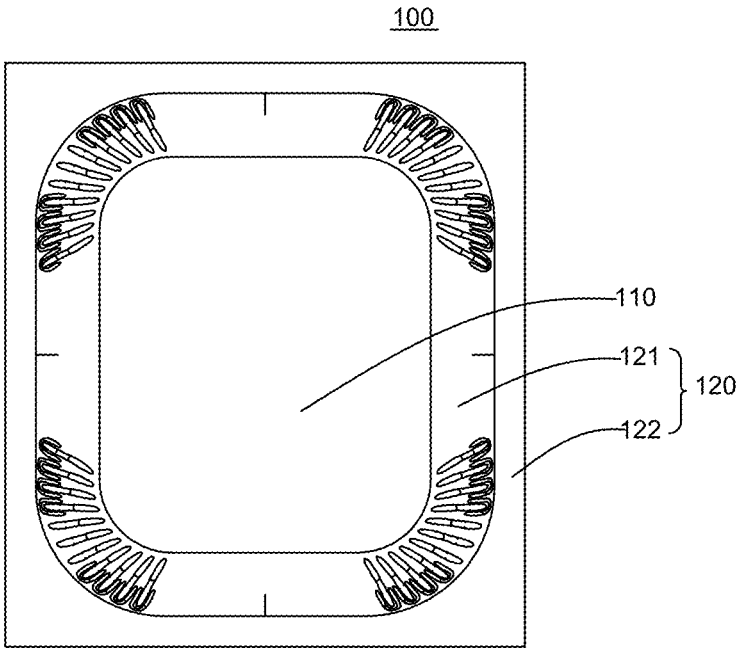
FIG. 3 is a front view of the vibration diaphragm in FIG. 1.

As shown in FIG. 1, FIG. 2 and FIG. 3, a vibration diaphragm 100 is disclosed, in accordance with an exemplary embodiment of the present disclosure. The vibration diaphragm 100 is mainly applied in the sound generating device of electronic equipment. The sound generating device typically comprises a magnetic circuit system and a vibration system, wherein the magnetic circuit system comprises a yoke and a magnet accommodated in the yoke, and there is a magnetic gap between the yoke and the magnet; and the vibration system comprises a voice coil suspended in the magnetic gap and the vibration diaphragm 100 which is connected with the voice coil and driven by the same to vibrate.

The vibration diaphragm 100 comprises a central dome part 110 and a suspension part 120 surrounding the dome part 110, wherein the suspension part 120 has an annular, protruding part 121 and a fixation part 122 extending outwards from the annular, protruding part 121. That is to say, the annular, protruding part 121 covers the central dome part 110.

The annular, protruding part 121 is provided with a number of first reinforcing parts 121*a* and a number of second reinforcing parts 121*b*, wherein each second reinforcing part 121*b* is provided as surrounding an end of the first reinforcing part 121*a*.

In the vibration diaphragm 100, the annular, protruding part 121 is provided with a number of first reinforcing parts 121*a* and a number of second reinforcing parts 121*b*, and each second reinforcing part 121*b* surrounds an end of the first reinforcing part 121*a*, which significantly improves the strength of the vibration diaphragm 100, reduces the vibration diaphragm collapsing, prolongs the life of the vibration diaphragm and allows the sounding device with the vibration diaphragm 100 to have an excellent sound generating performance.

It should be noted that no limitation is made to the structures of the first reinforcing parts 121*a* and the second reinforcing parts 121*b*, for example, their protruding direction may be the same as that of the annular, protruding part 121 or opposite to that of the annular, protruding part 121; no limitation is made herein.

In order to further improve the strength of the vibration diaphragm 100, both the first reinforcing parts 121*a* and the second reinforcing parts 121*b* are located at the corner 121*c* of the annular, protruding part 121, and the first reinforcing parts 121*a* extend from the outside of the corner 121*c* to the inside of the corner 121*c*.

In the vibration diaphragm 100 of the structure according to the embodiment, the provision of the first reinforcing parts 121*a* and the second reinforcing parts 121*b* at the corner 121*c* of the annular, protruding part 121 can effectively improve the strength of the vibration diaphragm 100 at the corner 121*c* and reduce the vibration diaphragm collapsing.

In order to further improve the strength of the vibration diaphragm 100 and reduce the vibration diaphragm collapsing, the second reinforcing part 121*b* may surround the end of the first reinforcing part 121*a* located outside of the corner 121*c*. Of course, the second reinforcing part 121*b* may also surround the other end of the first reinforcing part 121*a*, but preferably surrounds the end of the first reinforcing part 121*a* located outside of the corner 121*c*, which can effectively improve the strength of the vibration diaphragm and reduce the vibration diaphragm collapsing.

As one embodiment of the second reinforcing part 121*b*, the second reinforcing part 121*b* comprises a first extension part 121*b*1, a second extension part 121*b*2 and a bent part 121*b*3 connecting the first extension part 121*b*1 and the second extension part 121*b*2. The bent part 121*b*3 surrounds the end of the first reinforcing part 121*a* located outside of the corner 121*c*, and the first extension part 121*b*1 and the second extension part 121*b*2 are located on one side of the end respectively.

In the vibration diaphragm 100 of the structure according to the embodiment, second reinforcing parts 121*b* of the structure described above are provided. The second reinforcing part 121*b* comprises not only the bent part 121*b*3 surrounding the first reinforcing part 121*a*, but also the first extension part 121*b*1 and the second extension part 121*b*2 located on one side of the first reinforcing part 121*a* respectively, which further improve the strength of the vibration diaphragm at the corner 121*c*.

Specifically, the protruding direction of the first reinforcing part 121*a* and the second reinforcing part 121*b* is the same as that of the annular, protruding part 121.

Of course, as another structure of the first reinforcing parts 121*a* and the second reinforcing parts 121*b*, the protruding direction of the first reinforcing parts 121*a* and the second reinforcing parts 121*b* is opposite to that of the annular, protruding part 121.

Besides, the protruding direction of one of the first reinforcing parts 121*a* and the second reinforcing parts 121*b* is the same as that of the annular, protruding part 121, and the protruding direction of the other one is opposite to that of the annular, protruding part.

According to the configuration of the vibration diaphragm described above, the strength of the vibration diaphragm at the corners 121*c* can be effectively improved, and the vibration diaphragm collapsing is reduced. Taking the convenience of fabricating processes into consideration, the first reinforcing parts 121*a* and the second reinforcing parts 121*b* of the second structure are preferable, i.e. the protruding direction of both reinforcing parts is opposite to that of the annular, protruding part 121.

In order to further improve the strength of the vibration diaphragm, the corners 121*c* of the annular, protruding part 121 are rounded off.

A sounding device is provided according to the second aspect of the present utility model (not shown in figures). The sounding device comprises a magnetic circuit system (not shown in figures), a vibration system (not shown in figures) and a frame accommodating the magnetic circuit system and the vibration system (not shown in figures), wherein the vibration system includes the vibration diaphragm 100 described above.

The sounding device of the structure according to the embodiment includes the vibration diaphragm 100 described above. The vibration diaphragm 100 of such a structure has improved strength and does not collapse easily, so the life of the sounding device is prolonged and its sound generating effect is improved.

An electronic equipment (not shown in figures) is provided according to the third aspect of the present utility model, and the electronic equipment comprises the sounding device described above.

The electronic equipment of the structure according to the embodiment has the sounding device described above which has the vibration diaphragm 100 described above, the vibration effect of the electronic equipment is effectively improved and the life of the product is prolonged.

It should be noted that the electronic equipment may comprise electronic products such as cell phones, tablets.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A vibration diaphragm comprising:

a central dome part;

a suspension part surrounding the dome part, the suspension part having a protruding part and a fixation part extending outwards from the protruding part;

a plurality of first reinforcing parts disposed on the protruding part;

a plurality of second reinforcing parts disposed on the protruding part, each second reinforcing part surrounding an end of a corresponding first reinforcing part, wherein the second reinforcing part comprises a first extension part, a second extension part and a bent part connecting the first extension part and the second extension part, the bent part surrounds the end of the first reinforcing part near the fixation part of the suspension, the first extension part and the second extension part respectively locate on two opposite sides of the first reinforcing part.

2. The vibration membrane as described in claim 1, wherein the first reinforcing parts and the second reinforcing parts are located at corners of the suspension part.

3. The vibration membrane as described in claim 1, wherein a protruding direction of the first reinforcing part or the second reinforcing part is same to a protruding direction of the protruding part of the suspension part.

4. The vibration membrane as described in claim 1, wherein a protruding direction of the first reinforcing part or the second reinforcing part is opposite to a protruding direction of the protruding part of the suspension part.

5. The vibration membrane as described in claim 2, wherein the corners of the protruding part are rounded off.

* * * * *